US007579125B2

(12) United States Patent
Tong et al.

(10) Patent No.: US 7,579,125 B2
(45) Date of Patent: Aug. 25, 2009

(54) IMAGING MEMBER

(75) Inventors: Yuhua Tong, Webster, NY (US); Satchidanand Mishra, Webster, NY (US); Anthony M. Horgan, Pittsford, NY (US); Richard L. Post, Penfield, NY (US); Kathleen M. Carmichael, Williamson, NY (US); Edward F. Grabowski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 276 days.

(21) Appl. No.: 11/553,566

(22) Filed: Oct. 27, 2006

(65) Prior Publication Data

US 2008/0145781 A1 Jun. 19, 2008

(51) Int. Cl.
*G03G 5/14* (2006.01)

(52) U.S. Cl. ..... 430/33; 430/67

(58) Field of Classification Search ..... 430/66, 430/67

See application file for complete search history.

(56) References Cited

U.S. PATENT DOCUMENTS

| | | | | |
|---|---|---|---|---|
| 3,121,006 | A | 2/1964 | Middleton et al. | |
| 4,464,450 | A | 8/1984 | Teuscher | |
| 4,921,773 | A | 5/1990 | Melnyk et al. | |
| 5,368,967 | A | 11/1994 | Schank et al. | |
| 2006/0099525 | A1 * | 5/2006 | Yu et al. | 430/58.05 |
| 2007/0148575 | A1 * | 6/2007 | Mishra et al. | 430/66 |

* cited by examiner

*Primary Examiner*—John L Goodrow
(74) *Attorney, Agent, or Firm*—Eugene O. Palazzo; Fay Sharpe LLP

(57) ABSTRACT

An imaging member has a crosslinked overcoat layer which holds fluorinated nanoparticles. The overcoat layer is formed from an overcoat solution comprising a polymer binder; a hole transport molecule; fluorinated nanoparticles; a fluorinated surfactant; a crosslinking agent; and a free radical initiator. The overcoat layer provides excellent wear resistance at a low cost.

25 Claims, 1 Drawing Sheet

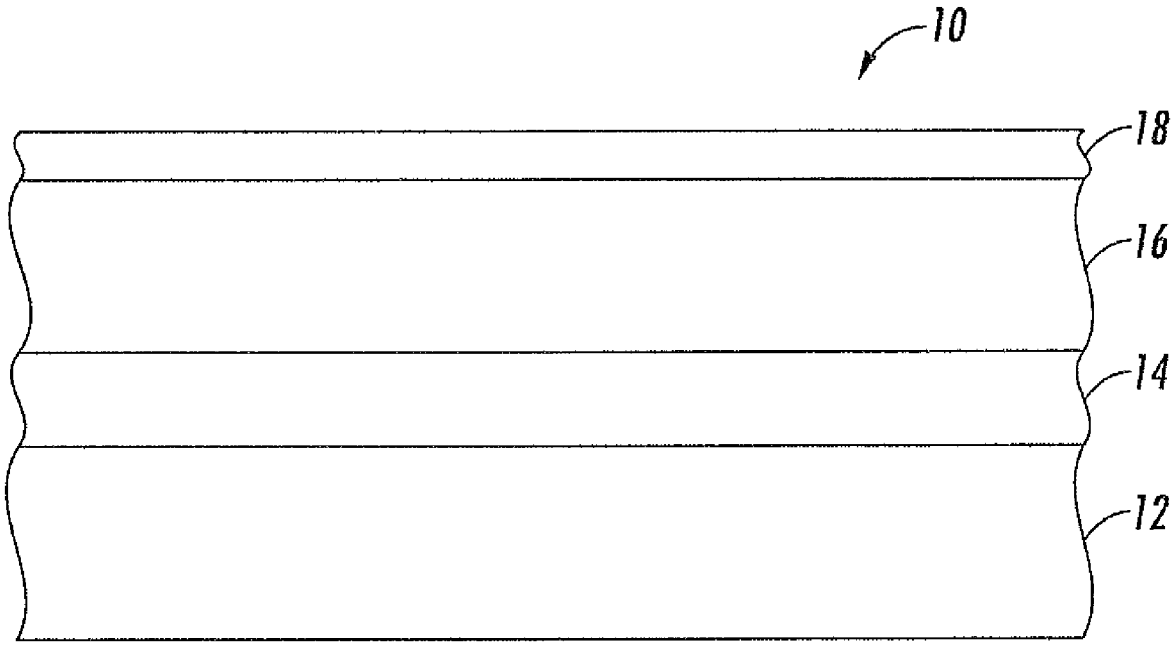
10
18
16
14
12

IMAGING MEMBER

BACKGROUND

The present disclosure relates, in various embodiments, to imaging members comprising an overcoat layer and methods of forming such imaging members. The overcoat layer in accordance with the present disclosure is a crosslinked polymer matrix which binds polytetrafluoroethylene nanoparticles.

In the art of electrophotography, an electrophotographic imaging member or plate comprising a photoconductive insulating layer on a conductive layer is imaged by first uniformly electrostatically charging the surface of the photoconductive insulating layer. The plate is then exposed to a pattern of activating electromagnetic radiation, for example light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles, for example from a developer composition, on the surface of the photoconductive insulating layer. The resulting visible toner image can be transferred to a suitable receiving member such as paper. This imaging process may be repeated many times with reusable photosensitive members.

Electrophotographic imaging members are usually multilayered photoreceptors that comprise a substrate support, an electrically conductive layer, an optional hole blocking layer, an optional adhesive layer, a charge generating layer, a charge transport layer, and an optional protective or overcoat layer(s). The imaging members can take several forms, including flexible belts, rigid drums, etc. For most multilayered flexible photoreceptor belts, an anti-curl layer is usually employed on the back side of the substrate support, opposite to the side carrying the electrically active layers, to achieve the desired photoreceptor flatness.

Imaging members are generally exposed to repetitive electrophotographic cycling which subjects exposed layers of imaging devices to abrasion, chemical attack, heat and multiple exposures to light. This repetitive cycling leads to a gradual deterioration in the mechanical and electrical characteristics of the exposed layers. For example, repetitive cycling has adverse effects on exposed portions of the imaging member. Attempts have been made to overcome these problems. However, the solution of one problem often leads to additional problems.

In electrophotographic imaging devices, the charge transport layer may comprise a high loading of a charge transport compound dispersed in an appropriate binder. The charge transport compound may be present in an amount greater than about 35% based on the weight of the charge transport layer. For example, the charge transport layer may comprise 50% of a charge transport compound in about 50% binder. A high loading of charge transport compound appears to drive the chemical potential of the charge transport layer to a point near the metastable state, which is a condition that induces crystallization, leaching and stress cracking when placed in contact with a chemically interactive solvent or ink. Photoreceptor functionality may be completely destroyed when a charge transport layer having a high loading of a charge transport molecule is contacted with liquid ink. It is thus desirable to eliminate charge transport molecule crystallization, leaching and solvent-stress charge transport layer cracking.

Cracks developed in the charge transport layer during cycling are a frequent phenomenon and most problematic because they can manifest themselves as print-out defects which adversely affect copy quality. Charge transport layer cracking has a serious impact on the versatility of a photoreceptor and reduces its practical value for automatic electrophotographic copiers, duplicators and printers.

Another problem encountered with electrophotographic imaging members is corona species induced deletion in print due to degradation of the charge transport molecules by chemical reaction with corona species. During electrophotographic charging, corona species are generated. Corona species include, for example ozone, nitrogen oxides, acids and the like.

Other problems affecting the performance of the imaging member include lateral charge migration and stress cracking in the photoreceptor. The concentration of charge transport molecules in the charge transport layer is a known factor affecting the degree of lateral charge migration. In particular, higher concentrations of charge transport molecules near the surface of the charge transport layer tend to result in a higher degree of lateral charge migration and more stress cracks.

Recent developments in reducing these defects have been directed to the formation of the charge transport layer. For example, the charge transport layer may be coated in two passes with a high loading of charge transport material in the first pass and a decreased loading of charge transport material in the second pass. The above two-pass coating should provide a charge transport layer with sufficient concentration of charge transport material for effective charge transport that has a reduced concentration of charge transport materials at the surface of the charge transport layer. The theoretical benefit of a lower concentration of charge transport material in the second pass is not completely achieved because the first layer tends to dissolve during coating of the second layer. This results in intermixing of the first pass and second pass layers and a greater concentration of charge transport material closer to the surface of the charge transport layer than is theoretically expected.

One approach to achieving longer photoreceptor drum life is to form a protective overcoat on the imaging surface, e.g. the charge transporting layer of a photoreceptor. This overcoat layer must satisfy many requirements, including transporting holes, resisting image deletion, resisting wear and avoidance of perturbation of underlying layers during coating.

There are many factors which go into making an effective, wear resistant overcoat layer. One factor is pot life. Since the drums are typically dip coated, one of the requirements for the overcoat material is ease and economical synthesis of materials and a coating solution pot life of several weeks. Pot life is the life of the coating composition without changes in its properties so that the same mixture can be used for several weeks. With coating compositions that ultimately cross-link and provide wear protection, there is a danger of initiation of cross-linking in the pot itself rendering the remaining material in the pot useless. Since the unused material must be discarded and the pot cleaned or replaced, this waste of material and effort has a significant negative impact on the manufacturing cost. In addition, the overcoat layer must be compatible with and adhere well to the charge transport layer on which it is placed. It must also have necessary electrical properties; it should transport holes, yet resist image deletion.

Because of these factors, as well as cost, most overcoat layers are generally very thin. They are usually less than 5 mm thick.

One of the toughest known overcoats includes cross-linked polyamide (e.g. Luckamide) containing N,N'-diphenyl-N,N'-bis(3-hydroxyphenyl)-[1,1'-biphenyl]-4,4'-diamine. This overcoat is described in U.S. Pat. No. 5,368,967, the entire disclosure of which is incorporated herein by reference. Durable photoreceptor overcoats containing cross-linked polyamide (e.g. Luckamide) and N,N'-diphenyl-N,N'-bis(3-hydroxyphenyl)-[1,1'-biphenyl]-4,4'-diamine (DHTBD) have been prepared using oxalic acid and trioxane to improve photoreceptor life by at least a factor of 3 to 4. The improved wear resistance involved cross-linking of Luckamide under heat treatment, e.g. 110° C.-120° C. for about 30 minutes. However, adhesion of this overcoat to certain photoreceptor charge transport layers, containing certain polycarbonates (e.g., Z-type 300) and charge transport materials [e.g., bis-N, N-(3,4-dimethylphenyl)-N-(4-biphenyl) amine and N,N'-diphenyl-N,N'-bis(3-methylphenyl)-[1,1'-biphenyl]-4,4'-diamine] is greatly reduced under such drying conditions. On the other hand, under drying conditions of below about 110° C., the overcoat adhesion to the charge transport layer was good, but the overcoat had a high rate of wear. Thus, there was an unacceptably small drying condition window for the overcoat to achieve the targets of both adhesion and wear rate.

Other known overcoats are formed from hydrolyzed siloxane gel or FX silicones. Unfortunately, these overcoats are very costly. In addition, they are relatively incompatible with most charge transport layers and do not adhere well to them.

Nano-size particles have been successfully used to reinforce polymer materials. For example, polytetrafluoroethylene (PTFE) nanoparticles have been used in organic photoreceptors. However, PTFE has low compatibility with other polymer binders like polycarbonate, which leads to unstable dispersion distribution leading to non-uniform morphology of the overcoat and large-scale particle aggregation.

There is a need for a relatively thick overcoat layer that will reduce lateral charge migration, deletion, and/or stress cracking in an imaging member while still providing an imaging member that exhibits satisfactory electrical properties.

BRIEF DESCRIPTION

Disclosed herein, in various embodiments, is a photoconductive imaging member having an overcoat layer and methods of producing such an imaging member. The overcoat layer is formed from an overcoat solution comprising a polymer binder, fluorinated nanoparticles, a fluorinated surfactant, a crosslinking agent, and a free radical initiator. The solution may further comprise a hole transport molecule.

Also included is the imaging member and overcoat layer produced by the methods and processes of utilizing the same for imaging.

The present disclosure, in further embodiments thereof, also includes an imaging member comprising a substrate; a charge generating layer; a charge transport layer comprising a charge transport molecule; and an overcoat layer. The overcoat layer is formed from an overcoat solution as described above. A method of imaging employing this imaging member is also included in the present disclosure.

These and other non-limiting features or characteristics of the disclosure are more particularly disclosed below.

BRIEF DESCRIPTION OF THE DRAWINGS

The following is a brief description of the drawings, which are presented for the purposes of illustrating the disclosure set forth herein and not for the purposes of limiting the same.

FIG. 1 is a schematic cross sectional view of a photoconductive imaging member in accordance with the present disclosure.

DETAILED DESCRIPTION

The present disclosure relates to a photoconductive imaging member having a charge transport layer and an overcoat layer. Also included within the scope of the present disclosure are methods of imaging and printing with the photoresponsive devices illustrated herein. These methods generally involve the formation of an electrostatic latent image on the imaging member, followed by developing the image with a toner composition, subsequently transferring the image to a suitable substrate, and permanently affixing the image thereto.

A more complete understanding of the processes and apparatuses disclosed herein can be obtained by reference to the accompanying drawings. These Figures are merely schematic representations based on convenience and the ease of demonstrating the present development, and are, therefore, not intended to indicate relative size and dimensions of the imaging devices or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to component of like function.

With reference to FIG. 1, a photoconductive imaging member in accordance with the present disclosure is shown. Photoconductive imaging member 10 comprises a substrate 12, a charge generating or photogenerating layer 14, a charge transport layer 16, and an overcoat layer 18. Overcoat layer 18 is formed from an overcoat solution in accordance with the present disclosure.

The substrate may be opaque or substantially transparent and may comprise any suitable material having the required mechanical properties. Accordingly, the substrate may comprise a layer of an electrically non-conductive or conductive material such as an inorganic or an organic composition. Various resins may be employed as non-conductive materials including polyesters, polycarbonates, polyamides, polyurethanes, and the like, which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like.

The thickness of the substrate layer depends on numerous factors, including strength and desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness, e.g., less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be from about 20 angstroms to about 750 angstroms, and more preferably from about 100 angstroms to about 200 angstroms for an optimum combination of electrical conductivity, flexibility, and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer may be utilized and such adhesive layer materials are well known in the art. Typical adhesive layer materials include, for example, polyesters, polyurethanes, and the like. Satisfactory results may be achieved with adhesive layer thickness from about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying, and the like.

At least one electrophotographic imaging layer is formed on the adhesive layer, blocking layer, or substrate. The electrophotographic imaging layer may be a single layer that performs both charge generating and charge transport functions, as is well known in the art, or it may comprise multiple layers such as a charge generator layer and charge transport layer. Charge generator (also referred to as photogenerating) layers may comprise amorphous films of selenium and alloys of selenium and arsenic, tellurium, germanium and the like, hydrogenated amorphous silicon and compounds of silicon and germanium, carbon, oxygen, nitrogen, and the like fabricated by vacuum evaporation or deposition. The charge generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakisazos; and the like dispersed in a film forming polymeric binder and fabricated by solvent coating techniques. Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene bisimide pigments; indigo pigments such as indigo, thioindigo, and the like; bisbenzoimidazole pigments such as Indofast Orange toner, and the like; phthalocyanine pigments such as titanyl phthalocyanine, aluminochlorophthalocyanine, hydroxygalliumphthalocyanine, and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. Alloys of selenium are encompassed by embodiments of the disclosure and include for instance selenium-arsenic, selenium-tellurium-arsenic, and selenium-tellurium.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine, magnesium phthalocyanine, and metal-free phthalocyanine. The phthalocyanines exist in many crystal forms, which have a strong influence on photo-generation.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrenealkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder. In embodiments, preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation, and the like. For some applications, the generator layer may be fabricated in a dot or line pattern. Removing the solvent of a solvent coated layer may be effected by any suitable conventional technique such as oven drying, infrared radiation drying, air drying and the like.

In fabricating a photosensitive imaging member, a charge generating material (CGM) or pigment, herein the terms "pigment" and "charge generating material" are used interchangeably, and a charge transport material (CTM) may be deposited onto the substrate surface either in a laminate type configuration where the CGM and CTM are in different layers or in a single layer configuration where the CGM and CTM are in the same layer along with a binder resin. A photoreceptor can be prepared by applying over the electrically conductive layer the charge generation layers and a charge transport layer. In embodiments, the charge generating layer and the charge transport layer may be applied in any order.

In embodiments, the charge generating layer adjacent to the charge transporting layer is partially trapping to charge generated in the other charge generating layer(s) which are passing through this layer to the charge transporting layer. Normally, the above photoexcited charges are holes so the generation layer adjacent to the transport layer must be partially trapping to holes transiting through it, but if the transport layer transports electrons it would be electron trapping. This functionality can be in the pigment itself, that is, the pigment may be a good electron transporter but a poor hole transporter. Such pigments are sometimes referred to as extrinsic pigments because they require the presence of hole transport, i.e., electron donor, molecules. Examples of extrinsic electron transporting pigments are perylene and azo pigments and their derivatives. The degree of hole trapping can be controlled by introducing hole transport molecules either directly or by diffusion from the charge transport layer. Examples of charge transport materials are listed below. Alternatively or in combination, additives can be used to increase the charge trapping. Thus in case of ambipolar, also referred to as intrinsic, pigments such as phthalocyanines, trapping additives in combination with charge transport molecules can be added. Suitable additives are other charge transport materials whose energy levels are 0.2 eV different from the primary charge transport molecule.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as arylamines; carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly(N-vinylcarbazole); poly(vinylpyrene); poly(-vinyltetraphene); poly(vinyltetracene) and poly(vinylperylene).

Aryl amines selected as the hole transporting component include molecules of the following formula

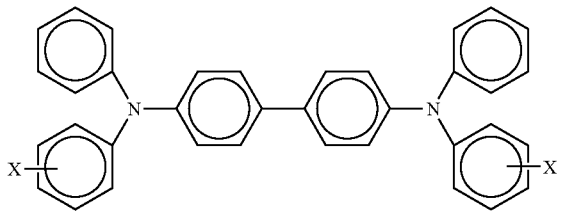

preferably dispersed in a highly insulating and transparent polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Suitable electron transport materials include electron acceptors such as 2,4,7-trinitro-9-fluorenone; 2,4,5,7-tetranitro-fluorenone; dinitroanthracene; dinitroacridene; tetracyanopyrene and dinitroanthraquinone, biphenylquinone derivatives and phenylquinone derivatives.

Any suitable inactive resin binder with the desired mechanical properties may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

Any suitable technique may be utilized to apply the charge transport layer and the charge generating layers. Typical application techniques include spraying, dip coating, roll coating, wire wound rod coating, vacuum coating, and the like. Drying of the deposited coating may be effected by any suitable conventional technique such as oven drying, infrared radiation drying, air drying and the like. Generally, the thickness of each charge generating layer ranges from about 0.1 micrometer to about 3 micrometers and the thickness of the transport layer is from about 5 micrometers to about 100 micrometers, but thicknesses outside these ranges can also be used. The thickness of the charge generating layer adjacent to the charge transport layer is selected to minimize the fraction of the photogenerated charge trapped in the charge generating layer. In general, the ratio of the thickness of the charge transport layer to the charge generating layer is preferably maintained from about 2:1 to 200:1 and in some instances as great as 400:1.

The overcoat layer is formed from an overcoat solution comprising a polymer binder, fluorinated nanoparticles, a fluorinated surfactant, a crosslinking agent, and a free radical initiator. The solution may further comprise a hole transport molecule and/or solvent.

The polymer binder can be selected from the group consisting of polycarbonates, polystyrenes, poly(methyl methacrylate), combinations thereof, and the like. In specific embodiments, the polymer binder is a polycarbonate. Examples of suitable polycarbonates include PCZ polymers, LEXAN™ polymers available from the General Electric Company and MAKROLON® polymers available from Bayer.

The polymer binder is present in an amount of from about 10 to about 90 weight percent, based on the weight of the dried overcoat layer. In other embodiments, the polymer binder is present in an amount of from about 30 to about 70 weight percent. In specific embodiments, the polymer binder is present in an amount of from about 40 to about 60 weight percent.

The fluorinated nanoparticles are generally made from fluoroelastomeric materials such as polytetrafluoroethylene (PTFE) and the like. They can have any shape, such as rod or sphere. The particles are less than 5 μm in diameter. For example, they can be about 2000 nm in diameter. They may be present in an amount of from about 1 to about 25 weight percent, based on the weight of the dried overcoat layer. In other embodiments, the nanoparticles are present in an amount of from about 3 to about 15 weight percent. In specific embodiments, the nanoparticles are present in an amount of from about 5 to about 10 weight percent.

When the fluorinated nanoparticles are incorporated into the overcoat solution, they may clump unevenly. However, if a fluorinated surfactant is included, the nanoparticles aggregate into uniform aggregates during high shear mixing, and thus are more uniformly sized and dispersed. One suitable fluorinated surfactant is GF-300 available from Toagosei Chemical Industries. GF-300 is a fluorinated graft copolymer. Others include GF-150 from Tongosei Chemical Industries; MODIPER F-600 from Nippon Oil & Fats Company; SURFLON S-381 and S-382 from Asahi Glass Company; FC-430, FC-4430, FC-4432 and FC-129 from 3M.

The surfactant level in the composition is important in maintaining the required dispersion quality and good electrical properties of the photoreceptor. Too much surfactant may result in high residual voltage. Too little surfactant may cause large aggregates of the nanoparticles. The optimum amount of surfactant will therefore depend, generally proportionally, on the amount of nanoparticles. Generally, the fluorinated surfactant is present in an amount of from about 0.01 to about 3.0 weight percent, based on the weight of the dried overcoat layer. In other embodiments, the surfactant is present in an amount of from about 0.08 to about 1.0 weight percent. In specific embodiments, the surfactant is present in an amount of from about 0.1 to about 0.3 weight percent.

The crosslinking agent promotes the formation of crosslinks between the various components of the overcoat solution, especially the polymer binder and any hole transport molecules (if present). The crosslinking occurs after the overcoat solution has been applied to the charge transport layer, i.e. during drying. The crosslinking agent may be bifunctional or multi-functional compounds such as dimethacrylated polyethylene glycol. It may also be an epoxy resin or blocked isocyanates. Generally, it must be compatible with the polymer binder as it will also form part of the crosslinked polymer matrix. In embodiments, the crosslinking agent selected from the group consisting of acrylates, methacrylates, epoxy resins, and isocyanates.

The crosslinking agent is present in an amount of from about 0.1 to about 30 weight percent, based on the weight of the dried overcoat layer. In other embodiments, the crosslinking agent is present in an amount of from about 0.5 to about 15 weight percent. In specific embodiments, the crosslinking agent is present in an amount of from about 1 to about 10 weight percent.

The free radical initiator initiates the crosslinking reaction between the various components of the overcoat solution. A suitable free radical initiator is 2,2'-azobisisobutyronitrile (AIBN). Any other free radical initiator known in the art may be used as well. The free radical initiator is present in the overcoat solution in an amount of from about 0.01 to about 5 weight percent, based on the weight of the crosslinking agent. In other embodiments, the free radical initiator is present in an amount of from about 0.1 to about 3 weight percent. In specific embodiments, the free radical initiator is present in an amount of from about 0.2 to about 1.5 weight percent.

If desired, a hole transport molecule may be added to the overcoat layer as well. The hole transport molecule aids in transporting holes across the overcoat layer and into the charge transport layer. The hole transport molecule will generally become part of the crosslinked polymer matrix itself.

Suitable hole transport molecules include triarylamines of the formula:

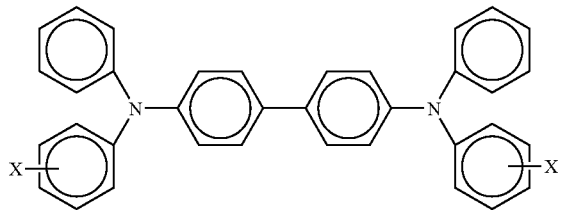

wherein X is selected from alkyl, alkoxy, aryl, and halogen. In particular embodiments, X is selected from the group consisting of $C_1$ and $CH_3$. Other suitable hole transport molecules have the formula:

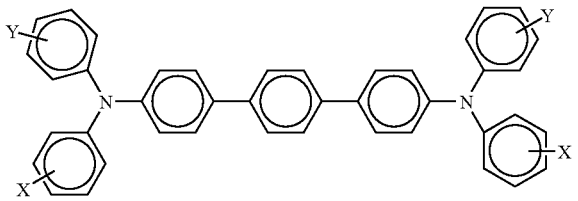

wherein X and Y are independently alkyl, alkoxy, aryl, and halogen. A highly suitable hole transport molecule is N,N'-bis(4-methylphenyl)-N,N'-bis(4-ethylphenyl)-[1,1'-biphenyl]-4,4'-diamine. In addition, N,N'-diphenyl-N,N'-bis(3-methylphenyl)-[1,1'-biphenyl]-4,4'-diamine (TPD), a known hole transport molecule, may also be used.

The hole transport molecule can be present in an amount of from about 0 to about 80 weight percent, based on the weight of the dried overcoat layer. In other embodiments, the hole transport molecule is present in an amount of from about 20 to about 60 weight percent. In specific embodiments, the hole transport molecule is present in an amount of from about 30 to about 50 weight percent.

The solvent of the overcoat solution is generally selected based on the polymer binder and, when present, the hole transport molecule, as both of these components must be soluble in the solvent Suitable solvents for the overcoat solution include, but are not limited to, tetrahydrofuran (THF), methylene chloride, methyl ethyl ketone (MEK), and any alcohol. It will be readily ascertainable by a skilled artisan what solvents will be suitable for the overcoat composition based on the selected composition of the charge transport layer. The overcoat solution will usually comprise about 5 percent solids, 95 percent solute. However, the total solids content can be from about 1 to about 20 weight percent by weight of the solution. In other embodiments, the total solids content is from about 2 to about 10 weight percent. In specific embodiments, the total solids content is from about 3 to about 6 weight percent. It should be noted that the amounts of the components above are given in terms of the dried overcoat layer because the solvent does not comprise any significant part of the finished overcoat layer.

The thickness of the overcoat layer may be selected as desired for a particular purpose or intended use. The thickness is selected in view of the desired electrical properties and the overcoat composition. If the overcoat layer is too thick, the background potential of the imaging member will increase. The upper limit of the thickness also depends on the polymer material used to form the overcoat layer and/or the molecular weight of the polymer material. The thickness of the dried overcoat layer may be from about 0.5 to about 10 μm. In other embodiments, the dried overcoat layer has a thickness of from about 1.0 to about 5 μm. In specific embodiments, the dried overcoat layer has a thickness of from about 2.0 to about 4 μm.

The overcoat solution can be prepared by any suitable conventional technique such as, for example, by mixing the solvent and the polymer material. The overcoat layer may be applied to the charge transport layer by any suitable application method. Non-limiting examples of suitable application methods include, for example, hand coating, spray coating, web coating, dip coating, and the like. Drying of the deposited coating can be effected by any suitable conventional technique such as, for example, oven drying, infrared radiation drying, air drying, and the like. The processing speed, drying temperature, and drying time are selected such that the overcoat layer has less than about 1% percent solvent remaining in the layer after drying.

After the overcoat solution has been applied, a crosslinked polymer matrix results. The fluorinated nanoparticles are generally bounded by the matrix and are kept in place to provide enhanced wear resistance to the imaging member. The matrix acts generally like a net that traps the nanoparticles; however, the nanoparticles may also bind to the matrix.

Aspects of the present disclosure are further understood with reference to the following examples. The examples are merely for further describing various aspects of an overcoat layer in accordance with the present disclosure and are not intended to be limiting embodiments thereof.

EXAMPLES

Example 1

An imaging member was prepared by providing a 0.02 micrometer thick titanium layer coated on a biaxially oriented polyethylene naphthalate substrate (KALEDEX™ 2000) having a thickness of 3.5 mils. A blocking layer was applied from a solution containing 50 grams 3-amino-propyltriethoxysilane, 41.2 grams water, 15 grams acetic acid, 684.8 grams of 200 proof denatured alcohol and 200 grams heptane. The blocking layer was then dried for about 2 minutes at 120° C. The resulting blocking layer had a dry thickness of 500 Angstroms.

An adhesive layer was applied from a solution containing 0.2 percent by weight based on the total weight of the solution of polyarylate adhesive (Ardel D100 available from Toyota Hsutsu Inc.) in a 60:30:10 volume ratio mixture of tetrahydrofuran/monochlorobenzene/methylene chloride. The adhesive layer was then dried for about 2 minutes at 120° C. The resulting adhesive layer had a dry thickness of 200 angstroms.

A charge generating layer dispersion was prepared by introducing 0.45 grams of Lupilon200® (PC-Z 200) available from Mitsubishi Gas Chemical Corp and 50 ml of tetrahydrofuran into a 4 oz. glass bottle. To this solution was added 2.4 grams of hydroxygallium phthalocyanine and 300 grams of ⅛ inch (3.2 millimeter) diameter stainless steel shot. This mixture was then placed on a ball mill for 8 hours. Subsequently, 2.25 grams of PC-Z 200 was dissolved in 46.1 gm of tetrahydrofuran, and added to this OHGaPc slurry. This slurry was then placed on a shaker for 10 minutes. The resulting slurry was then applied to the adhesive layer with a Bird applicator to form a charge generating layer having a wet thickness of 0.25 mil. A strip about 10 mm wide along one edge of the substrate web bearing the blocking layer and the adhesive layer, was deliberately left uncoated to facilitate adequate electrical contact by the ground strip layer that was to be applied later. The charge generating layer was dried at 120° C. for 1 minute to form a charge generating layer having a thickness of 0.4 micrometer.

A charge transport layer containing 50 weight percent (based on the total solids) of hole transport compound, N,N'-diphenyl-N,N'-bis(3-methyl-phenyl)-(1,1'-biphenyl)-4,4'-diamine was applied to the charge generator layer. In a four ounce brown bottle, 10 grams of MAKROLON® 5705 (available from Bayer Chemicals) was dissolved in 113 grams of methylene chloride. After the polymer was completely dissolved, 10 grams of N,N'-diphenyl-N,N'-bis(3-methylphenyl)-1,1'-biphenyl-4,4'-diamine was added to the solution. The mixture was shaken overnight to assure a complete solution. The solution was applied onto the charge generating layer using a 4.5 mil Bird bar to form a coating. The coated device was then heated at 120° C. for 1 minute to form a charge transport layer having a dry thickness of 29 micrometers.

Overcoat Solution Preparation

Example 2

In a 250-ml brown bottle, 2.0 grams of the hole transport molecule N,N'-bis(4-methylphenyl)-N,N'-bis(4-ethylphenyl)-[1,1'-biphenyl]-4,4'-diamine, 2.25 grams of the polycarbonate PCZ-500, 0.45 grams of PTFE nanoparticles, 0.01 grams of the fluoro-surfactant GF-300, 0.4 grams of Bisphenol A glycerolate dimethacrylate, 0.1 grams of methacrylated silicone fluid, and 0.01 grams of free radical initiator AIBN were charged with 95 grams of tetrahydrofuran, then 50 grams of glass beads of 3 mm diameter were added. The bottle was set in a paint-shaker to mix the materials for 3 hours. Then, the solution was ready for coating.

Example 3

In a 250-ml brown bottle, 2.0 grams of the hole transport molecule N,N'-diphenyl-N,N'-bis(3-methyl-phenyl)-(1,1'-biphenyl)-4,4'-diamine, 2.25 grams of the polycarbonate PCZ-500, 0.45 grams of PTFE nanoparticles, 0.01 grams of the fluoro-surfactant GF-300, 0.4 grams of Bisphenol A glycerolate dimethacrylate, 0.1 grams of methacrylated silicone fluid, and 0.01 grams of free radical initiator AIBN were charged with 95 grams of tetrahydrofuran, then 50 grams of glass beads of 3 mm diameter were added. The bottle was set in a paint-shaker to mix the materials for 3 hours. Then, the solution was ready for coating.

Fabrication of Photoreceptor Device with Overcoat

Example 4

The overcoat solution of Example 2 was coated using a 0.5 mil Bird-bar on the photoreceptor of Example 1. The coated device was dried at 120° C. for 15 minutes. The resulting photoreceptor device had a crosslinked overcoat binding PTFE nanoparticles of about 1.0 micron in thickness.

Example 5

The overcoat solution of Example 3 was coated using a 0.5 mil Bird-bar on the photoreceptor of Example 1. The coated device was dried at 120° C. for 15 minutes. The resulting photoreceptor device had a crosslinked overcoat binding PTFE nanoparticles of about 1.0 micron in thickness.

Electrical Test

The flexible photoreceptor sheets prepared as described in Example 1 (without overcoat) and Example 5 (with overcoat) were tested for their xerographic sensitivity in a scanner. In the scanner, each photoreceptor sheet to be evaluated was mounted on a cylindrical aluminum drum substrate which was rotated on a shaft. The devices were charged by a direct current pin corotron mounted along the periphery of the drum. The surface potential was measured as a function of time by capacitively coupled voltage probes placed at different locations around the shaft. The probes were calibrated by applying known potentials to the drum substrate. Each photoreceptor sheet on the drum was exposed to a light source located at a position near the drum downstream from the corotron. As the drum was rotated, the initial (pre-exposure) charging potential was measured by a voltage probe. Further rotation led to an exposure station, where the photoreceptor device was exposed to monochromatic radiation of a known intensity. The devices were erased by a light source located at a position upstream of charging, then charged to a negative polarity corona. The surface potential after exposure was measured by a second voltage probe. The devices were finally exposed to an erase lamp of appropriate intensity and any residual potential was measured by a third voltage probe. The process was repeated with the magnitude of the exposure automatically changed during the next cycle. The photodischarge characteristics were obtained by plotting the potentials at a voltage probe as a function of light exposure. The charge acceptance and dark decay were also measured in the scanner. The charge acceptance was measured by operating the corotron in a constant current mode. VDDP, the dark development potential, is the potential remaining on the device at a specified time after the charging step. Table 1 shows the resulting electrical data. The measurements illustrated in Table 1 included the charging of each photoconductor device in a constant current or voltage mode. No significant change was seen in the electrical data.

TABLE 1

Electrical Data

| Example | Background Voltage after expose cycle1 | Background Voltage after expose cycle 10K | Erase Voltage cycle 1 | Erase Voltage cycle 10k | Dark Decay cycle 1 | Dark Decay cycle 10k |
|---|---|---|---|---|---|---|
| 1 | 50 | 95 | 18 | 29 | 57 | 43 |
| 5 | 56 | 112 | 22 | 41 | 57 | 40 |

Scratch Test

Ten (10) scratches were performed using a conical diamond stylus with tip radius of 17 microns on each of the coatings by increasing the normal load to 1000 μN at a rate of 10 μN/s over a scratch distance of 20 microns. The friction coefficient was calculated by dividing the measured lateral force by the normal load. The maximum depth of the scratches ranged from 150 nm to 200 nm.

Two photoreceptor surfaces (from Examples 1 and 4) were submitted for scratch resistance analysis. The experimental overcoat was 1.0 micron thick. As control, an uncoated photoreceptor with a 29 micron thick charge transport layer consisting of 50% polycarbonate, 50% of TPD was also evaluated. The scratch resistance was measured with a 17 micron conical diamond stylus penetrating the coating at increasing load to about 200 nm in depth. The friction coefficient and incurred friction force was lower for the overcoat. This indicates better scratch resistance of these coatings as compared to the uncoated control sample. Table 2 summarizes the measured surface mechanical properties.

TABLE 2

Mechanical Properties

| Example | Friction Coefficient | Standard Deviation | Max. Friction Force (μN) | Standard Deviation | Modulus (GPa) | Standard Deviation | Hardness (GPa) | Standard Deviation |
|---|---|---|---|---|---|---|---|---|
| 1 | 1.30 | 0.01 | 247.68 | 24.56 | 8.18 | 0.46 | 0.70 | 0.05 |
| 4 | 0.06 | 0.01 | 64.92 | 9.61 | 6.08 | 0.69 | 0.67 | 0.05 |

Generally, if the friction force and the friction coefficient are low, the likelihood of permanent damage is lower. The data showed that the overcoat had lower friction force and friction coefficient than the control sample but the hardness was comparable. Therefore, the overcoat had better scratch resistance.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. An imaging member, comprising:

a substrate;

a charge transport layer; and an crosslinked overcoat layer formed from an overcoat solution comprising:

a polymer binder;

fluorinated nanoparticles in an amount of from about 1 to about 25 weight percent, based on the weight of the dried overcoat layer;

a fluorinated surfactant in an amount of from about 0.01 to about 3.0 weight percent, based on the weight of the dried overcoat layer;

a crosslinking agent; and a free radical initiator.

2. The imaging member of claim 1, wherein the polymer binder is selected from the group consisting of polycarbonates, polystyrenes, poly(methyl methacrylate), and combinations thereof.

3. The imaging member of claim 1, wherein the polymer binder is present in an amount of from about 10 to about 90 weight percent, based on the weight of the dried overcoat layer.

4. The imaging member of claim 3, wherein the polymer binder is present in an amount of from about 40 to about 60 weight percent, based on the weight of the dried overcoat layer.

5. The imaging member of claim 1, wherein the fluorinated nanoparticles are made of polytetrafluoroethylene (PTFE).

6. The imaging member of claim 1, wherein the fluorinated nanoparticles are less than 5 μm in diameter.

7. The imaging member of claim 1, wherein the fluorinated nanoparticles are present in an amount of from about 5 to about 10 weight percent, based on the weight of the dried overcoat layer.

8. The imaging member of claim 1, wherein the fluorinated surfactant is a fluorinated graft copolymer.

9. The imaging member of claim 1, wherein the fluorinated surfactant is present in an amount of from about 0.1 to about 0.3 weight percent, based on the weight of the dried overcoat layer.

10. The imaging member of claim 1, wherein the crosslinking agent is selected from the group consisting of acrylates, methacrylates, epoxy resins, and isocyanates.

11. The imaging member of claim 1, wherein the crosslinking agent is present in an amount of from about 0.1 to about 30 weight percent, based on the weight of the dried overcoat layer.

12. The imaging member of claim 11, wherein the crosslinking agent is present in an amount of from about 1 to about 10 weight percent, based on the weight of the dried overcoat layer.

13. The imaging member of claim 1, wherein the free radical initiator is 2,2'-azobisisobutyronitrile (AIBN).

14. The imaging member of claim 1, wherein the free radical initiator is present in the overcoat solution in an amount of from about 0.01 to about 5 weight percent, based on the weight of the crosslinking agent.

15. The imaging member of claim 14, wherein the free radical initiator is present in the overcoat solution in an amount of from about 0.2 to about 1.5 weight percent, based on the weight of the crosslinking agent.

16. The imaging member of claim 1, wherein the overcoat solution further comprises a hole transport molecule.

17. The imaging member of claim 16, wherein the hole transport molecule is N,N'-bis(4-methylphenyl)-N,N'-bis(4-ethylphenyl)-[1,1'-biphenyl]-4,4'-diamine or N,N'-diphenyl-N,N'-bis(3-methylphenyl)-[1,1'-biphenyl]-4,4'-diamine.

18. The imaging member of claim 16, wherein the hole transport molecule is present in an amount of from about 0 to about 80 weight percent, based on the weight of the dried overcoat layer.

19. The imaging member of claim 18, wherein the hole transport molecule is present in an amount of from about 30 to about 50 weight percent, based on the weight of the dried overcoat layer.

20. The imaging member of claim 1, wherein the overcoat solution further comprises a solvent selected from the group consisting of tetrahydrofuran (THF), methylene chloride methyl ethyl ketone (MEK) and an alcohol.

21. The imaging member of claim 1, wherein the dried overcoat has a thickness of from about 0.5 to about 10 μm.

22. A method of imaging, comprising:

generating an electrostatic latent image on the imaging member of claim 1;

developing the latent image; and transferring the developed image to a suitable substrate.

23. An imaging member, comprising:

a substrate;

a charge transport layer; and a crosslinked overcoat layer, comprising:

a polymer binder;

a hole transport molecule;

fluorinated nanoparticles in an amount of from about 1 to about 25 weight percent, based on the weight of the dried overcoat layer;

a fluorinated surfactant in an amount of from about 0.01 to about 3.0 weight percent, based on the weight of the dried overcoat layer;

a crosslinking agent; and a free radical initiator;

wherein at least the polymer binder, hole transport molecule, and crosslinking agent form a crosslinked polymer matrix.

24. The imaging member of claim 23, wherein the polymer binder is a polycarbonate.

25. The imaging member of claim 23, wherein the hole transport molecule is N,N'-bis(4-methylphenyl)-N,N'-bis(4-ethylphenyl)-[1,1'-biphenyl]-4,4'-diamine or N,N'-diphenyl-N,N'-bis(3-methylphenyl)-[1,1'-biphenyl]-4,4'-diamine.

* * * * *